United States Patent [19]

Seaman

[11] Patent Number: 4,653,201

[45] Date of Patent: Mar. 31, 1987

[54] COMBINED MIRROR AND DRYER AIR OUTLET ASSEMBLY

[75] Inventor: John W. Seaman, Sheboygan Falls, Wis.

[73] Assignee: Kohler Co., Kohler, Wis.

[21] Appl. No.: 817,466

[22] Filed: Jan. 9, 1986

[51] Int. Cl.[4] ..... F26B 23/06

[52] U.S. Cl. ..... 34/90; 34/97; 34/243 R; 219/219; 219/366; 219/368

[58] Field of Search ..... 34/90, 97, 233, 243 R; 132/9, 102; 219/370, 369, 373, 366, 368, 219, 219/361

[56] References Cited

U.S. PATENT DOCUMENTS

| | | | |
|---|---|---|---|
| D. 275,601 | 9/1984 | Doman . | |
| 1,454,151 | 5/1923 | Brown . | |
| 3,384,977 | 5/1968 | Rosenberg . | |
| 3,578,000 | 5/1971 | Horecky | 34/90 |
| 3,590,218 | 6/1971 | Steiner . | |
| 3,872,607 | 3/1975 | Klaus . | |
| 4,161,955 | 7/1979 | Webb . | |
| 4,225,106 | 9/1980 | Eplan . | |

*Primary Examiner*—Larry I. Schwartz
*Attorney, Agent, or Firm*—Quarles & Brady

[57] ABSTRACT

A combined mirror and dryer air outlet assembly is mountable to a support such as a wall or a pole. An attachment member such as a cup is affixed to the support. A rotatable housing is connected thereto in a manner to prevent separation, yet permit relative rotation. A mirror and air outlet are mounted on the housing, usually at the front. This permits the height of the air outlet to be changed by rotating the housing. In a preferred version, the housing contains a blower fan and motor as well as an electric heating coil.

11 Claims, 8 Drawing Figures

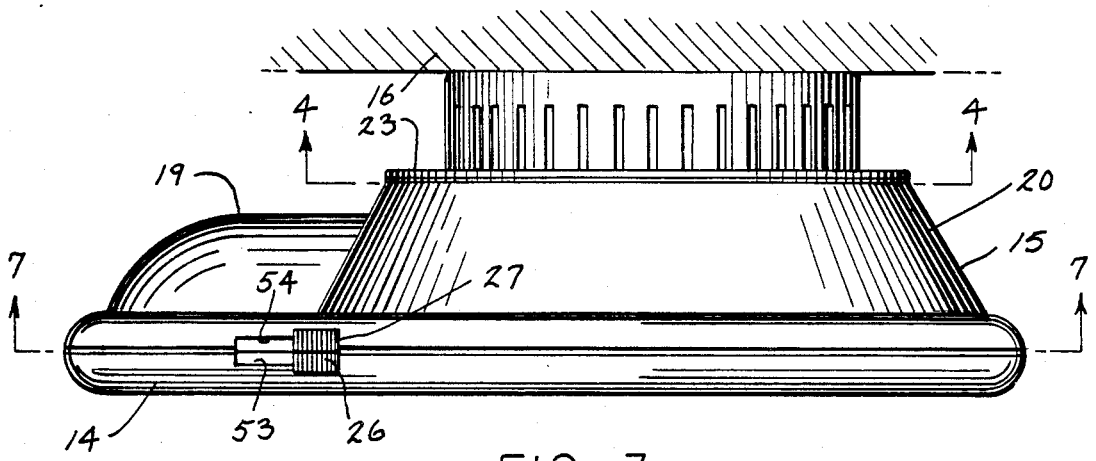
FIG. 3
FIG. 4
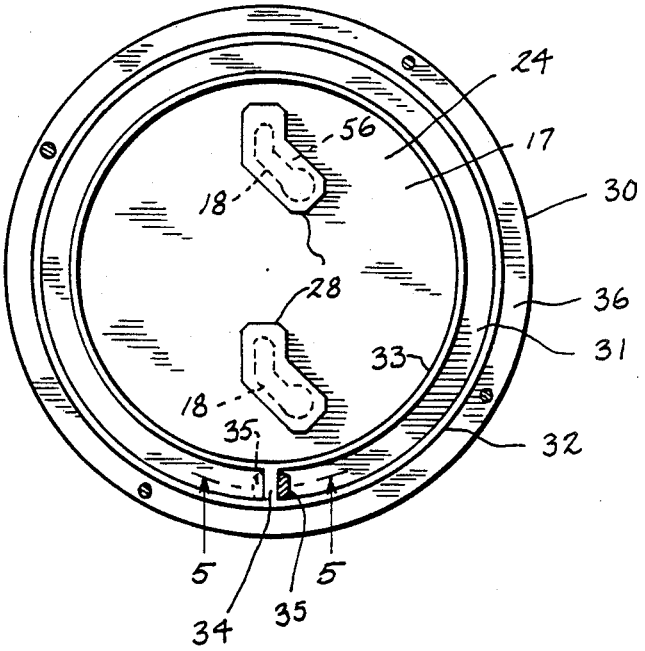
FIG. 5
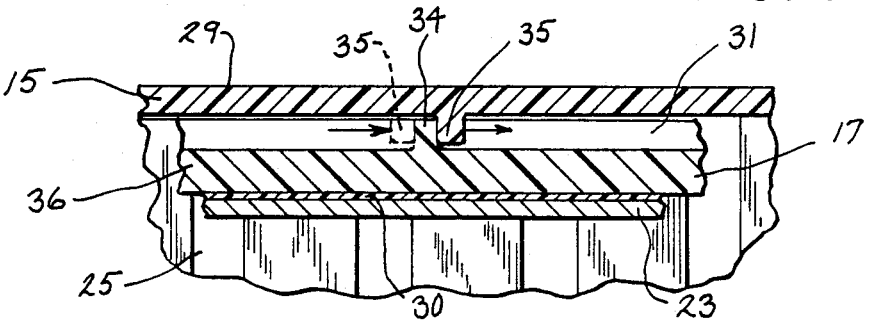

FIG. 7
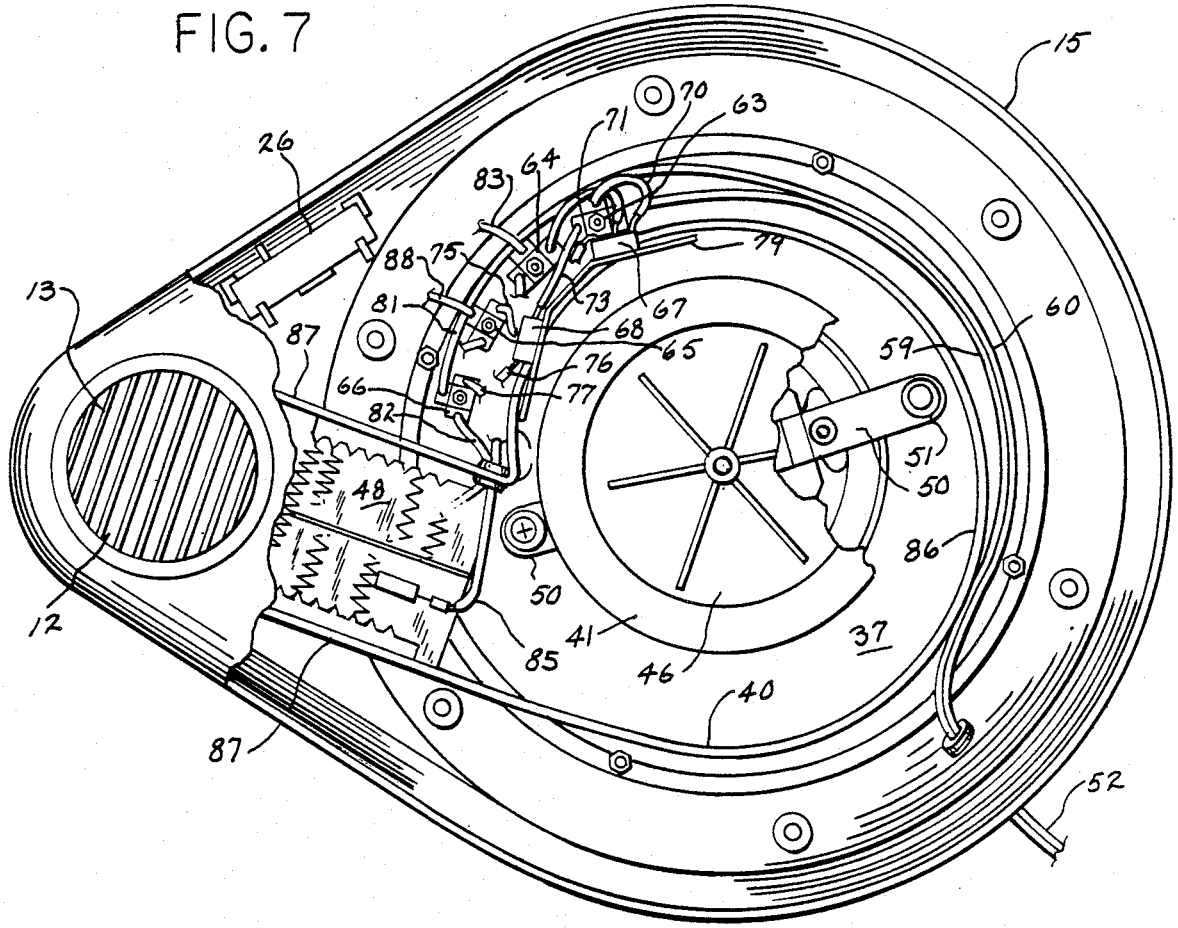
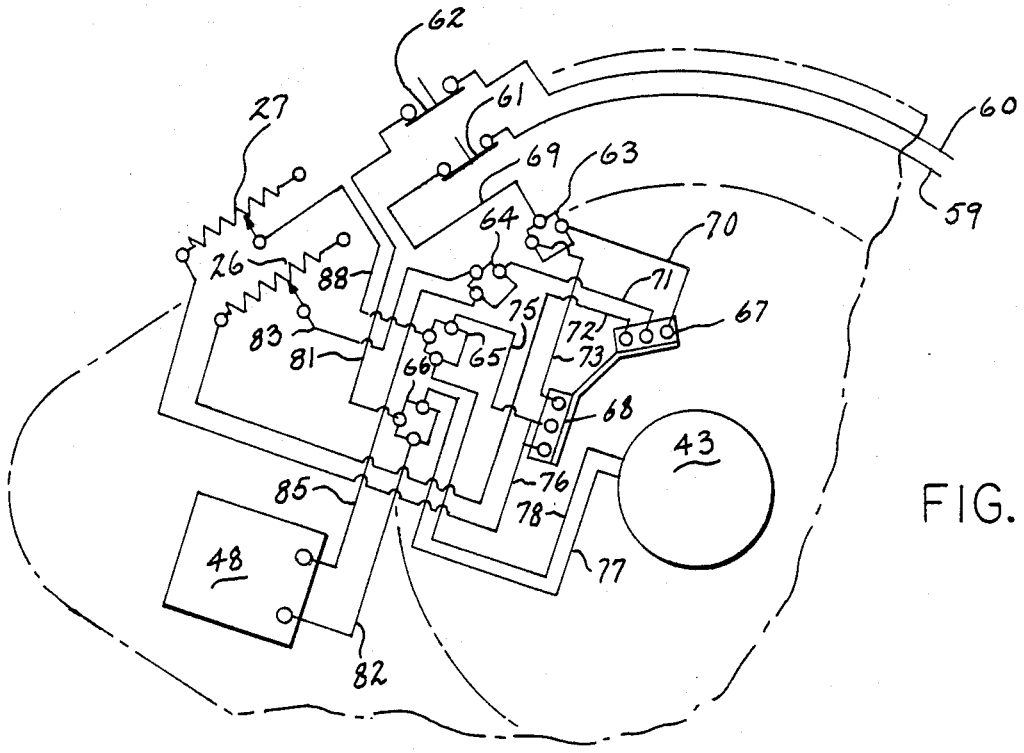
FIG. 8

COMBINED MIRROR AND DRYER AIR OUTLET ASSEMBLY

BACKGROUND OF THE INVENTION

A. Field of the Invention

This invention relates to a combined mirror and dryer air outlet assembly, and more particularly to a unit where the outlet can be rotated so as to adjust its height relative to a support structure such as a bathroom wall.

B. Description of the Prior Art

There are currently known modular wall mountable electrical dryer units with mirrors (see e.g. U.S. Pat. No. Des. 275,601). However, such units do not permit easy adjustment of the dryer outlet position, and thus users of differing heights do not receive equal drying effect without using adapter hoses or, in some cases, assuming uncomfortable positions. There are also available hand-held dryer units (which can be used in front of a wall-mounted mirror). However, these do not permit the user to have both hands free for arranging the hair during drying. Thus, it can be seen that a need has existed for an improved wall mountable combined mirror and dryer outlet assembly.

SUMMARY OF THE INVENTION

In one aspect, the invention provides a combined mirror and dryer air outlet assembly of the type suitable to be mounted on a substantially vertical support structure. There is an attachment member suitable to be fixed to the support structure. A housing is connectable to the attachment member so as to permit relative rotation therebetween. There are means for restricting movement of the housing away from the attachment member. A mirror and dryer air outlet are mounted on the housing. This permits the height of the outlet to be changed relative to the support structure by rotating the housing relative to the attachment means.

In another aspect of the invention, the attachment member is a cup-shaped housing and an electric fan motor is at least partially positioned in the cup. There may also be a blower and heater mounted in the housing and hot air from the heater could be blown by the blower out of the outlet.

In a preferred embodiment, the housing extends radially out from the cup circumference and the restricting means is a clamping ring positioned around the cup. In another preferred form, there are means to limit relative rotation of the housing and cup to less than 360° so that the electrical cord does not become entangled.

In yet another embodiment, the mirror and outlet are positioned on the front of the housing and the support structure is a pole or a bathroom wall.

In an especially preferred form, the housing is formed from two separate pistol-shaped halves, with a blower fan and heater mounted in between the halves.

The objects of the invention therefore include providing:

(a) A combined mirror and dryer assembly which will permit vertical plane rotation parallel to a vertical wall.

(b) A combined mirror and dryer assembly of the above kind which will afford vertical height adjustment of the outlet by rotation of the housing member.

(c) A combined mirror and dryer assembly of the above kind which is sturdy in its construction and is easily disassembled and reassembled to facilitate repairs. These and still other objects and advantages of the present invention will be apparent from the description which follows.

In the following description, the preferred embodiments of the invention will be disclosed with reference to the accompanying drawings. These embodiments do not represent the full scope of the invention. Rather, the invention may be employed in other embodiments. Reference is therefore to be made to the claims herein for interpreting the scope of the present invention.

BRIEF DESCRIPTION OF THE DRAWINGS

FIG. 3 is a top plan view of the unit;

FIG. 4 is a sectional view taken along line 4—4 of FIG. 3;

FIG. 5 is a sectional view taken along line 5—5 of FIG. 4;

FIG. 7 is a partial sectional view taken along line 7—7 of FIG. 3; and FIG. 8 is a diagrammatic view illustrating the electrical wiring connections for the heating element and blower assembly of the unit.

DESCRIPTION OF THE PREFERRED EMBODIMENTS

Figure 1:
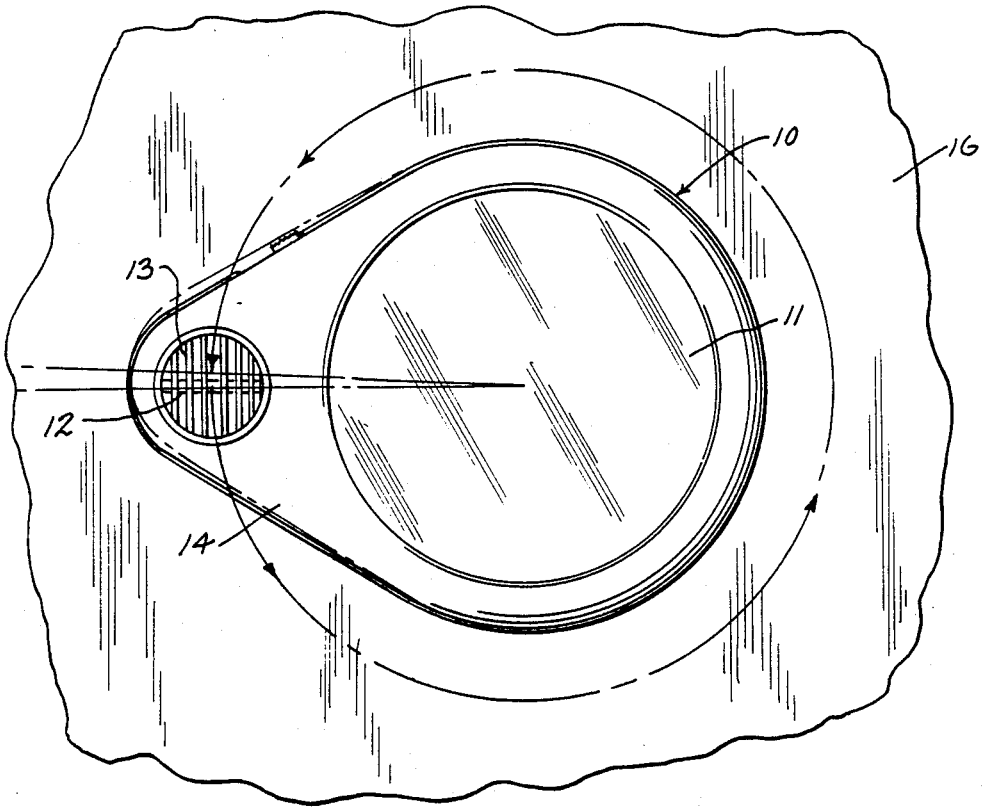
FIG. 1 is a front view in elevation of a combined mirror and hair dryer unit mounted on a vertical bathroom wall.
Figure 2:
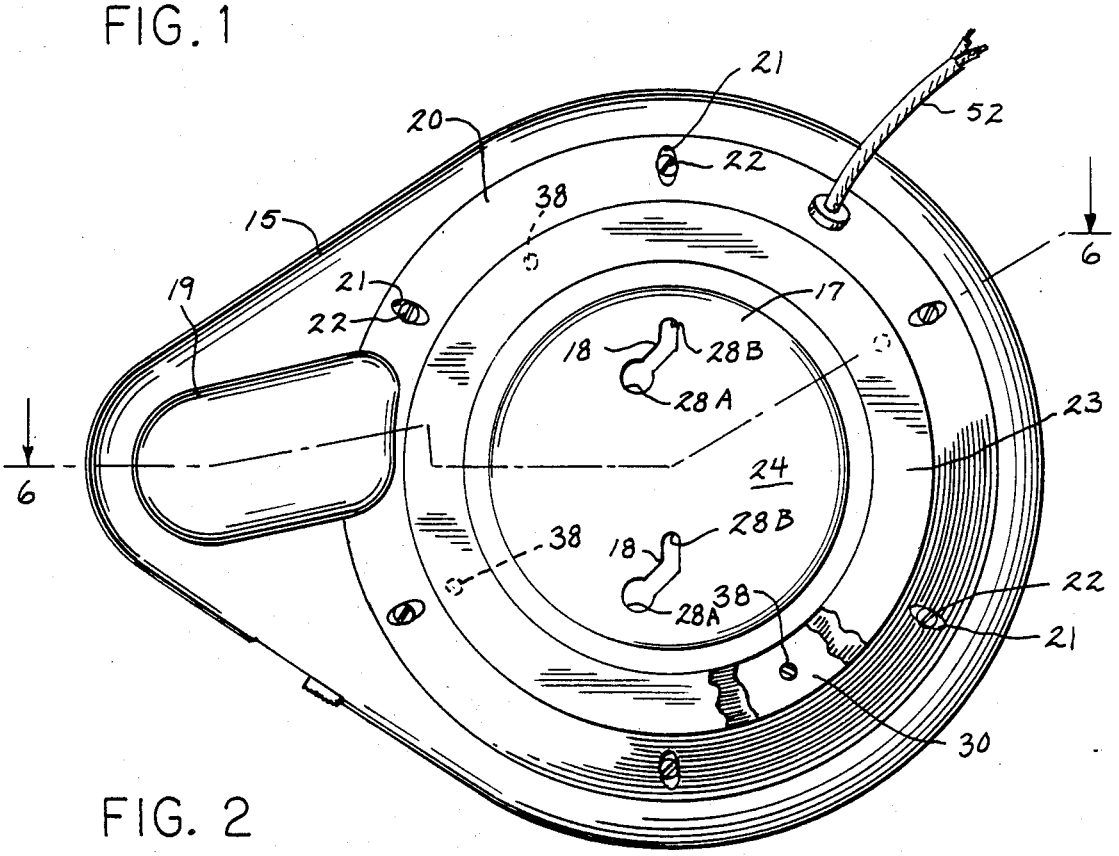
FIG. 2 is a rear view in elevation of the unit of FIG. 1.
Figure 6:
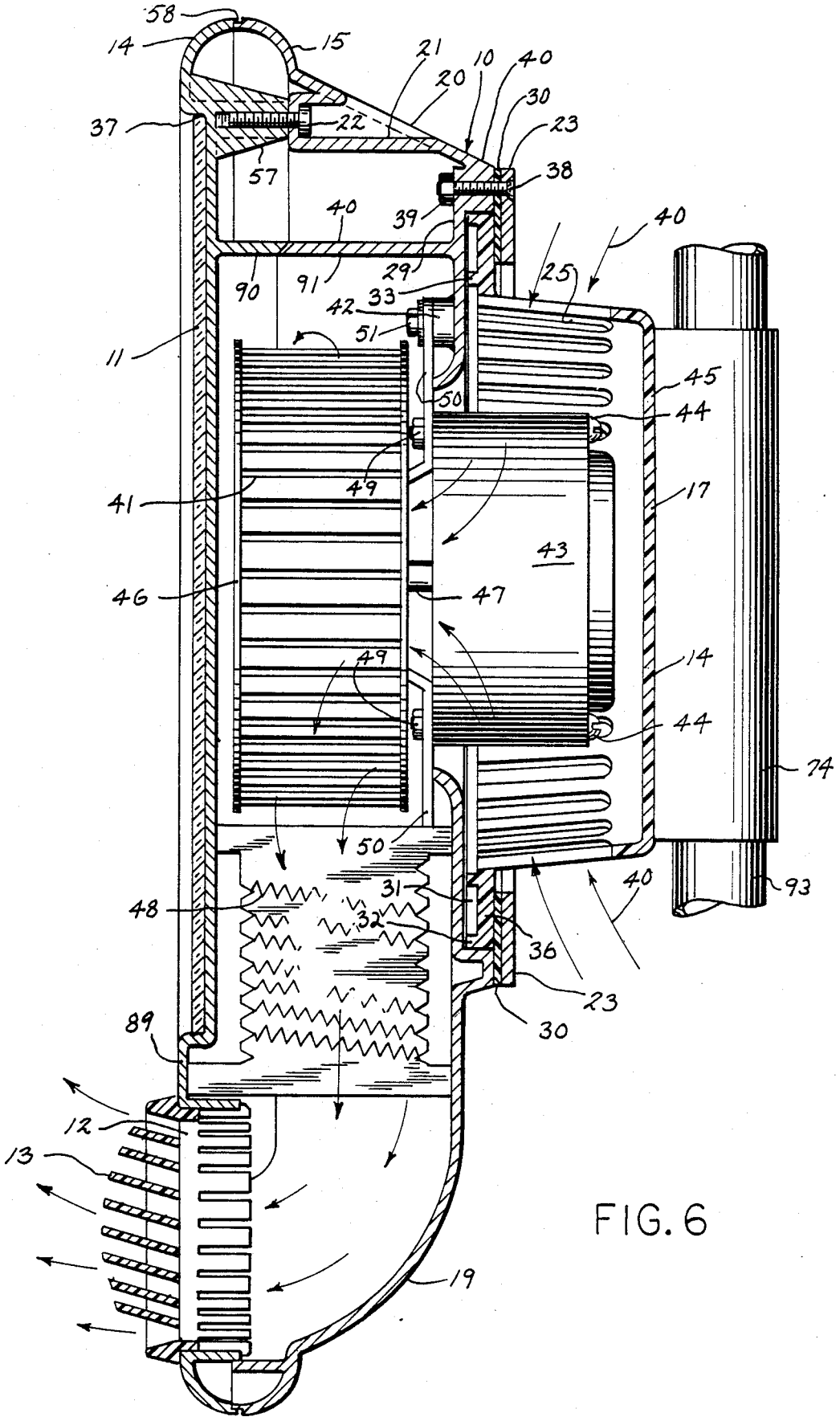
FIG. 6 is a sectional view taken along line 6—6 of FIG. 2.

Referring first to FIGS. 1, 2 and 6 of the drawings, the unit 10 includes a mirror 11 mounted on the front of a front housing 14. A dryer outlet 12 is positioned at the front adjacent the mirror. It may have the usual vent grill 13. In the alternative, a coupling for a hose could be provided. The front housing 14 is connected to an intermediate housing 15, which in turn slidably receives a cup-shaped rear housing or attachment member 17. Keyhole type slots 18 (compare FIGS. 2 and 4) are provided in the cup 17 to provide a means of attachment to a supporting surface, such as vertical bathroom wall 16.

It will be noted that slots 18 have a slot base 28 spaced (in a direction away from the bathroom wall) from the cup wall 24 of the rear housing 17. Heads of two screws (not shown) pre-positioned in bathroom wall 16 can pass into the large hole end 28A, between slot base 28 and the wall 24. They can then catch on the narrowed segment 28B as the unit is slid down onto the screws.

Referring specifically to FIGS. 2 and 6, the intermediate housing 15 is secured to the front housing 14 by additional screws 22 which are received through mounting apertures 21 of the flared wall 20. The cup 17 is rotably connected to the intermediate housing 15 by the mounting flange 23 having the bolts 38 extending therethrough and attached to the intermediate housing 15. To aid in this sliding arrangement, slide ring 30 also will receive the bolts 38 for attachment to the intermediate housing 15 but permitting slidable engagement with the rear housing 17.

Referring specifically to FIGS. 3 and 7, it will be noted that there is disposed between the housing 14 and 15 two slide switches 26 and 27 for movement in the slots 53 and 54 of their respective housings 14 and 15. Slidable switches 26 and 27 are of the usual variable resistance type so as to control the speed of a blower mechanism as well as the intensity of a heater. These components will be later described in more detail.

Also shown in FIG. 4 is the race way 31 provided in the circumferential flange portion 36 of the cup 17. The race way is defined by the circumferential flanges 32 and 33. Disposed between these flanges is rib 34.

FIG. 5 demonstrates the controlled rotation of the intermediate housing 15 relative to this rib 34 to prevent entanglement of cord 52. An inwardly (towards the wall) extending projection 35 extends from the wall 29 of the housing 15 and will travel in the race way 31 until it engages the stop ledge 34. This will prevent more than 360° rotation, yet will afford just slightly less than such rotation for maximum flexibility in positioning of the dryer outlet 12 with respect to the mirror 11. Also indicated in FIG. 5 is the placement of the mounting flange 23 over the slide ring 30 for slidably retaining rear housing flange 36. This feature will become clearer with respect to the following operation and fabrication.

Referring to FIGS. 6–8, it will be seen that the blower fan 46 is centrally positioned in the housing members 15 and 16 and has an annular bladed housing 41. It is also axially positioned with respect to cup 17. As best seen in FIG. 7, wall member 40 extends upwardly from the recessed portion 37 and is of generally pistol configuration. The "handle" portion 86 of the "pistol" will house the blower fan 46 and the "barrel portion" 87 houses the electrical heating coil 48. The wall 40 is formed in two pistol shaped halves with a portion extending from front housing 14 as indicated at 90 and another portion 91 extending from intermediate housing 15. It is interrupted in two portions so as to permit the insertion of plate member 79. This plate member has attached thereto the phase controllers 67 and 68 as will be later explained in connection with the operation and fabrication of this unit.

OPERATION AND FABRICATION

A better understanding of the advantages of the unit will be had by description of the operation and fabrication. As shown in FIG 6, mirror 11 is mounted (e.g., with an adhesive) in a recessed portion 37 of the support wall 83 of the front housing 14. Housing 14 has internally threaded mounting bosses such as 57 for receiving the mounting screws 22 positioned in the mounting apertures 21. It will also be seen that the interconnection of the housing 14 and an intermediate housing 15 is assisted by undercut portion 58.

Prior to the interconnecting of the front and intermediate housings 14 and 15, the electric motor 43 will be secured to housing 15. Brackets 50 are connected to a bearing assembly (not shown) at one end and to the mounting bosses such as 42 extending from the support walls 29. Screws 44 with the nuts 49 also provide attachment of the motor 43 to the motor brackets 50. Attached to the motor shaft 47 is the blower fan 46 which will be retained thereon in a non-rotatable manner by the usual friction fit engagement.

The next step in the fabrication is to mount the cup 17 onto the intermediate housing 15. The rear housing flange 36 of the rear housing 17 will be placed on the support wall 29 with the race way 31 suitably positioned therewith. Placed on top of the flange 36 is the slide ring 30 and the mounting flange ring 23. The mounting flange ring 23 and the slide ring 30 will have the bolts 38 passed therethrough and connected to the mounting portion 40 of the intermediate housing 15.

The electrical inlet cord 52 (FIGS. 2 and 7) has the power lines 59 and 60 which are connected to the disconnect switches 61 and 62. The purpose of the disconnect switches is to prevent the electrical current from flowing through the unit in the event that the hair dryer should be dropped into a large volume of water such as that contained in a bathtub. These disconnect swtiches could for example, be operated by the slide switches 26 and 27 when they are in the off position.

Referring specifically to FIGS. 7 and 8, the switch 61 is connected to the phase controllers 67 and 68 such as by the lines 69, 70 and 73 and the three way connector 63. Switch 62 is interconnected to the motor 43 by the lines 81 and 77 connected through the three-way connector 66 and to the electrical coil 48 by the line 82. Motor switch 27 is connected to phase controller 68 by the line 76. Phase controller 68 is in turn connected to three-way connector 65 by the line 75 and is interconnected to switch 27 by the line 88. Heater switch 26 is connected to phase controller 67 by line 72. Phase controller 67 is interconnected with heater coil 48 by line 71 connected to three-way connector 64 which also connects line 85 to the heater coil 48 as well as line 83 to switch 26. Motor 43 is connected to three-way connector 65 by line 78. The phase controllers in this instance are a standard type and are available from the Omnetics Company of Syracuse, N.Y. under the brand name Omnephase.

When it is desired to utilize the combined mirror and dryer 10, all that is required is that the rear housing 17 be mounted to a wall surface. If desired and as an optional feature, a suitable bracket 74 can be attached to the outside of the rear housing 17 for adjustable attachment to a support pole 93. In either case, the inlet cord 52 will be suitably attached to an electrical outlet.

It will be appreciated that the combined mirror and hair dryer will be secured to the wall surface at a height which will be suitable to the average range of users. Variable adjustment of the dryer outlet 12 will be effective for the very tall or very small user by the rotative movement of the housings 14 and 15 with respect to the stationary rear housing 17. Rotation can continue until the projection stop 35 extending from the housing 15 engages the stop ledge 34 extending across the race way 31 in the flange 36.

At the same time suitable adjustment of heat will be provided by the slidable switch 26 electrically connected to the heater element 48 as previously described. As indicated above, the blower motor 43 as well as the blower fan 46 will be activated as well as the speed thereof controlled by the slidable switch 27. Outside air will be introduced through the vents 25 of the rear housing 17 and pulled downwardly into the intermediate housing 15. This is best seen in FIG. 6 in conjunction with the direction arrows 40. Air will be pulled into the central core of the fan 46 and forced out into the pistol handle housing portion 86. (See FIG. 7) From there it will be forced into the pistol barrel portion 87 and over the heater coil 48,. the heated air will then move outwardly through the air passageway 19 in the housing 15. It will exit both housings 14 and 15 by means of the air outlet 12 extending through support wall 89 as well as exit the vent grill 13.

Thus, the invention provides a unique construction for a combined dryer outlet and mirror wherein vertical plane rotation parallel to a wall or a support surface is provided. This rotation of the mirror and the blower over a back fixed part is preferably afforded through the use of a unique clamping ring structure.

In the event that repairs are required, the unit affords easy disassembly. Note also that through the use of a circular mirror, one has the surprising impression that the mirror does not move even when the outlet does.

While certain preferred embodiments have been described above, it will be readily apparent to those skilled in the art that a number of other modifications and changes can be made without departing from the scope of the invention. For example, the slide ring 30 and the mounting flange 23 have been shown as two separate components for providing slidable engagement with the flange 36 of the cup 17. If desired, these components could be fabricated in a unitary manner with mounting flange 23 being provided with a low friction surface in the form of a laminate. Also, the mirror need not be circular, and the front and intermediate housings could be integrally formed. Further, instead of a cup, the attachment means could be other forms of rotation poles. Therefore it is intended that the scope of the invention not be limited by description of the preferred embodiments alone.

I claim:

1. A combined mirror and dryer air outlet assembly of the type suitable to be mounted on a substantially vertical support structure, the improvement comprising:

an attachment member suitable to be fixed to said support structure, a housing connectable to said attachment member so as to permit relative rotation therebetween;

means for restricting movement of said housing away from said attachment member; and a mirror and said dryer air outlet being mounted on the housing, said mirror being on the front of said housing; said dryer air outlet being offset with respect to the rotational axis of the housing whereby the height of the outlet relative to the support structure may be changed by rotating the housing relative to the attachment member.

2. The assembly of claim 1, wherein the attachment member is a cup-shaped housing.

3. The assembly of claim 2, wherein the electric motor is at least partially positioned in said cup.

4. The assembly of claim 3, wherein a blower and heater are mounted in said housing and hot air from the heater can be blown by the blower out of the outlet.

5. The assembly of claim 2 wherein the housing extends radially out from the cup circumference and said restricting means is a clamping ring positioned around said cup.

6. The assembly of claim 2 further comprising ledge stop means extending between the housing and the cup to limit relative rotation of the housing and cup to less than 360°.

7. The assembly of claim 2, wherein the mirror and outlet are positioned on the front of the housing.

8. The assembly of claim 2, wherein the support structure is a pole.

9. The assembly of claim 2, wherein said housing is formed from two separate pistol shaped halves, with a blower fan and heater mounted in between the halves.

10. The assembly of claim 1, wherein said mirror rotates with said housing.

11. The assembly of claim 10 wherein said mirror is circular.

* * * * *

UNITED STATES PATENT AND TRADEMARK OFFICE

CERTIFICATE OF CORRECTION

PATENT NO. : 4,653,201

DATED : Mar. 31, 1987

INVENTOR(S) : Seaman

It is certified that error appears in the above-identified patent and that said Letters Patent is hereby corrected as shown below:

Col. 3, line 25, after "of" --a-- should appear

Col. 4, line 60, "48,. the" should read --48. The--

Col. 5, line 30, "structure," should read --structure;--

Col. 6, line 10, "the" should read --an--

Signed and Sealed this

Sixth Day of October, 1987

*Attest:*

DONALD J. QUIGG

*Attesting Officer*

*Commissioner of Patents and Trademarks*